US005941699A

United States Patent [19]

Abele

[11] Patent Number: 5,941,699

[45] Date of Patent: Aug. 24, 1999

[54] SHUTOFF SYSTEM FOR GAS FIRED APPLIANCES

[75] Inventor: Alan C. Abele, Marblehead, Ohio

[73] Assignee: Mr. Heater, Inc., Cleveland, Ohio

[21] Appl. No.: 08/853,044

[22] Filed: May 8, 1997

[51] Int. Cl.[6] ..... F23N 5/10

[52] U.S. Cl. ..... 431/80; 126/92 AC; 251/129.15; 431/59; 431/66; 137/66

[58] Field of Search ..... 431/80, 59, 66; 126/91 R, 92 B, 92 AC, 351, 374; 251/129.01, 129.06, 129.09, 129.15; 137/65, 66, 909

[56] References Cited

U.S. PATENT DOCUMENTS

| | | | |
|---|---|---|---|
| 4,299,554 | 11/1981 | Williams | 431/76 X |
| 4,569,329 | 2/1986 | Cherryholmes | 126/92 R X |
| 4,696,639 | 9/1987 | Bohan, Jr. | 431/80 |
| 5,591,024 | 1/1997 | Eavenson et al. | 431/80 |
| 5,752,818 | 5/1998 | Foster | 126/92 AC |

FOREIGN PATENT DOCUMENTS

| | | | |
|---|---|---|---|
| 54-140235 | 10/1979 | Japan | F23N 5/24 |

*Primary Examiner*—Larry Jones
*Attorney, Agent, or Firm*—Fay, Sharpe, Beall, Fagan, Minnich & McKee

[57] ABSTRACT

Shutoff system for a gas fired appliance includes a shutoff for increased carbon monoxide concentration. A proximity sensor is associated with a thermocouple and conventional solenoid shutoff valve. Slight changes in the current resulting from temperature variations monitored by the thermocouple provide an indication of increased carbon monoxide levels. The thermocouple sensor is also preferably placed in the plenum to monitor the temperature of primary and/or secondary screens associated with the gas fired appliance. Moreover, a reflector, or concentrating element such as a parabolic reflector, focuses the radiant energy on the thermocouple.

9 Claims, 2 Drawing Sheets

SHUTOFF SYSTEM FOR GAS FIRED APPLIANCES

BACKGROUND OF THE INVENTION

It is known in the industry to provide a portable gas fired appliance that doesn't require an external power supply. The appliance typically includes a mesh screen that covers a plenum in which the gas is oxidized. The plenum acts as a reflector to direct the heat toward the mesh screen and evenly distribute it over the surface thereof. A flame sensor is usually incorporated into the assembly to provide a shutoff if the appliance is no longer operating properly.

The flame sensor is a thermocouple device that is positioned to sense the flame or an infrared bandwidth spectrum of approximately 600°. For example, a sensor is mounted outside the plenum and directed toward the flame so that as long as a flame condition is sensed, sufficient current is supplied to a coil of a solenoid shutoff valve that supplies gas to the appliance. When energized, the coil creates a magnetic force that is sufficient to overcome the biasing force of a spring that urges the valve member toward a normally closed position. Thus, if a flame out condition is sensed, insufficient current is supplied to the solenoid coil and the valve member moves to the closed position, shutting off the supply of gas to the appliance. These types of shutoff assemblies have met with commercial success and are widely used in the industry.

Another area of increasing concern associated with these appliances, however, relates to carbon monoxide levels. There is an ever increasing emphasis on monitoring carbon monoxide levels with these types of gas fired appliances, particularly where there is a desire to use the appliance indoors or in, for example, the camping environment. The existing flame sensor cannot serve as a carbon monoxide sensor. Moreover, existing flame sensors or oxygen depletion sensors are based on a pilot flame or require an external source of power. Additionally, these arrangements are sensitive to ambient conditions, such as wind, humidity, elevation, or motion, and the desired carbon monoxide sensor should be immune to ambient conditions. Thus, there is a need to provide a sensor that can be used to detect carbon monoxide levels without these associated drawbacks.

SUMMARY OF THE INVENTION

In accordance with the subject invention, flue gas emissions are monitored, and particularly carbon monoxide levels are sensed, based on the temperature detected by a thermocouple. It has been determined that particular design of the burner plenum creates a unique signature of the temperature associated with the gas-fired appliance upon a drop in oxygen relative to the carbon monoxide level. Particularly, as oxygen begins to be depleted, the flame degrades in marginal areas of the primary screen. As the temperature increases over time, it experiences a drop before sharply rising to an elevated level. It has also been recognized that carbon monoxide levels begin to quickly increase at the same time that the drop in temperature is detected. Accordingly, increased carbon monoxide concentration can be correlated with a brief drop in temperature over a short period of time.

By monitoring this unique signature with a proximity sensor associated with the solenoid valve, minor variations in the current generated by the thermocouple will indicate that carbon monoxide levels are beginning to rise. Accordingly, the proximity sensor is used to short the circuit and allow the solenoid valve to return to its normally closed position.

DETAILED DESCRIPTION OF THE PREFERRED EMBODIMENT

Figure 1:
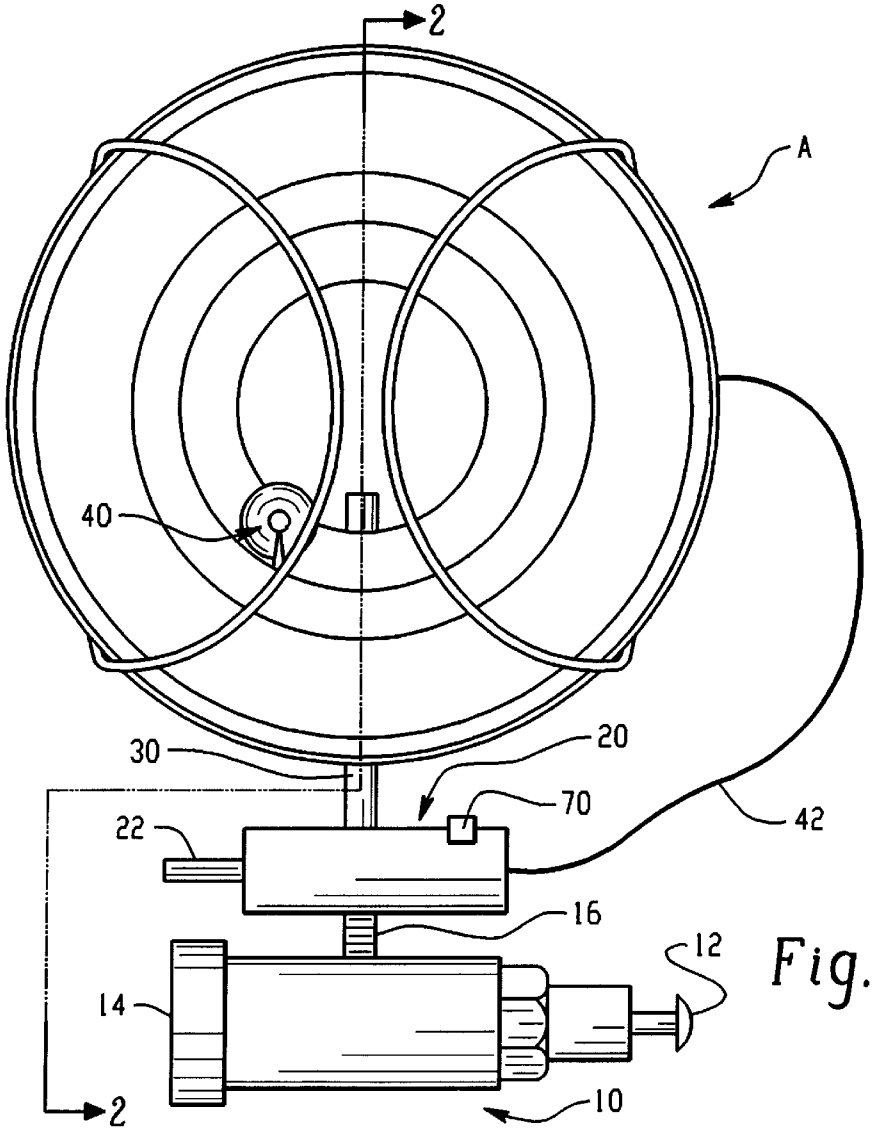
FIG. 1 shows a plan view of a typical gas fired burner.

FIG. 1 shows a typical gas fired appliance A such as a small heater adapted for communication with a supply of fuel such as propane gas (not shown). A main control valve 10 includes a fitting 12 at one end adapted to be threadably connected to the gas supply in a conventional manner. As shown, for example, the fitting includes a nipple having an o-ring so when the fitting is threadably engaged with the gas supply tank, a sealed connection is formed. A manually adjustable handle 14 is provided at the other end and controls an internal valve member (not shown) to control the amount of gas flow passing from the supply to the appliance A. The handle may have preselected positions such as "off", "low", "medium" and "high" which are rotational positions of the handle relating to preselected openings in the valve member 10.

An automated shutoff valve 20 is then mounted to the outlet 16 of the main valve member. The shutoff valve is a preferably a solenoid type valve with a manual plunger 22 used for start-up purposes. As is well known in the art, when the plunger 22 is depressed, the fuel gas is permitted to flow through the valve 20 to the main supply line 30. The plunger must be depressed against the force of a normally closed biasing spring (not shown) to open the fuel path. The burner is then ignited, and once the flame is detected, thermocouple 40 senses the flame and sends current through line 42 to the coil associated with the solenoid valve 20. As long as a flame is detected, current flows through the line 42 and the coil maintains the valve member open against the closing force exerted by a spring (not shown). If the flame is extinguished, no current is provided through the line 42 and the internal spring associated with the solenoid valve urges the valve member to its closed position to shut off the supply of fuel. As described at this point, this preferred embodiment is well known in the art and commercially available.

Figure 2:
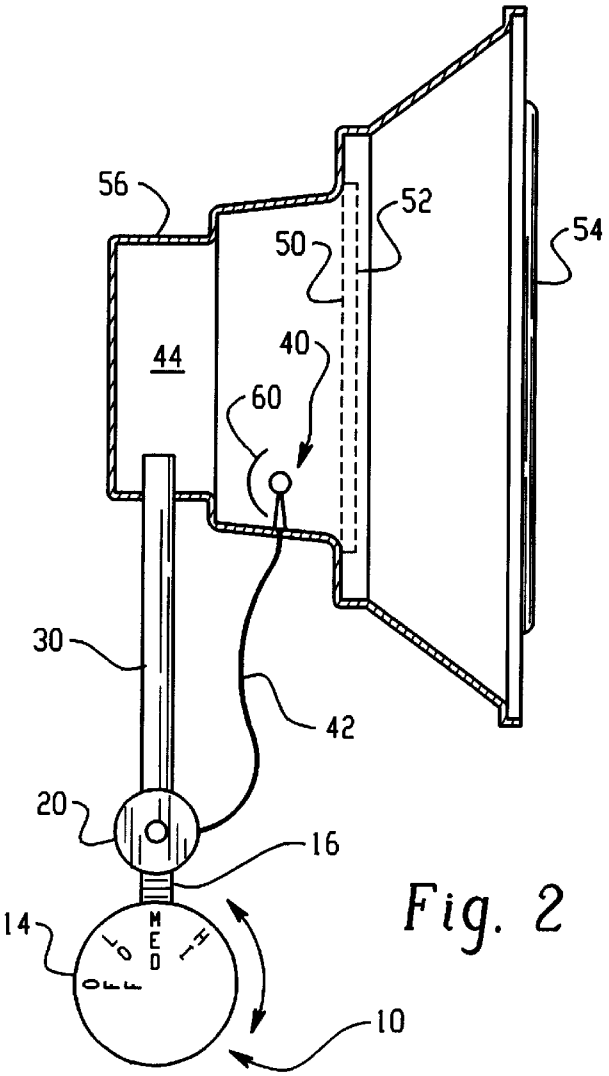
FIG. 2 is a cross sectional view taken approximately along lines 2—2 of FIG. 1.

In accordance with the subject invention, the thermocouple 40 is preferably placed within the plenum 44 of the gas fired burner. Thus, as best illustrated in FIGS. 1 and 2, the thermocouple 40 is disposed in the plenum behind the first, or primary, mesh screen 50 and secondary screen 52. As is understood in the art, the primary screen 50 is a fine mesh and preferably has smaller openings than the secondary mesh screen 52. A third screen, actually a guard 54, is clamped onto the outer, open end of the housing.

By disposing the thermocouple 40 within the plenum 56, i.e., behind the primary and secondary screens 50, 52, the thermocouple is substantially immune from conditions such as wind, which might otherwise adversely effect the operation of the thermocouple. Moreover, it is preferred to use a reflector 60, such as a parabolic reflector, mounted adjacent the thermocouple so that the radiant energy emitted by the screens 50, 52 is focused on the thermocouple 40. As described above, the thermocouple senses the radiant energy or temperature of the primary and/or secondary screens. Current is then generated through line 42 by the thermocouple to maintain the valve 20 in an open position. The thermocouple is focused to detect the flame degradation along a marginal region of the screens. Thus, and as briefly described above, when oxygen depletion begins to occur, the marginal region of the screen first experiences flame degradation while the central area of the screen may continue to exhibit normal operating characteristics. The temperature then exhibits a noticeable or detectable drop followed by a continued increase in the temperature in this region of the screen.

Figure 3:
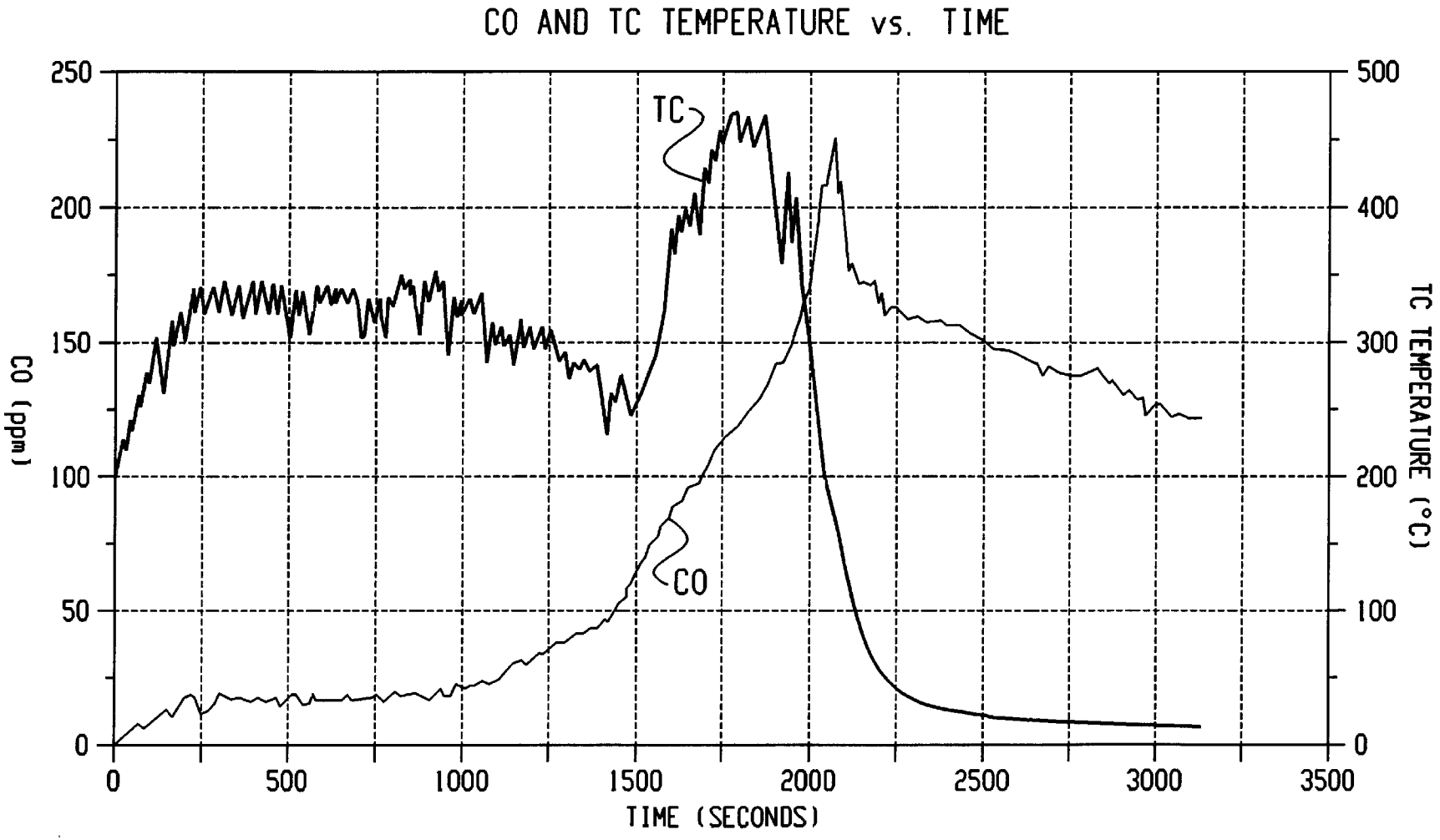
FIG. 3 is a graphical representation illustrating the correlation between temperature and carbon monoxide levels over time.

As illustrated in FIG. 3, a unique signature or drop in temperature occurs at approximately the same time that a substantial increase is detectable in the generation of carbon monoxide. Accordingly, by monitoring the effect of the temperature reduction that occurs as a result of oxygen depletion, the carbon monoxide concentration can likewise be monitored. Thus, the solenoid shutoff valve is modified by including a proximity sensor such as a Hall-effect sensor or switch that monitors the current through wire 42 to the shutoff valve 20. The magnetic field will experience a change upon a decrease in current that is indicative of the drop in temperature of the thermocouple associated with the increase in carbon monoxide concentration as illustrated in FIG. 3. The output of the proximity sensor acts as a switch to short the circuit so that the biasing force of the spring then urges the valve member to the closed position.

Shown in FIG. 1, the proximity sensor is represented by numeral 70 and is a modification to a conventional shutoff valve. It is intended to monitor the magnetic field associated with the solenoid coil and able to detect slight increases or decreases in the current provided through line 42. This information can then be used as an effective carbon monoxide sensor since the relationship between the temperature of the thermocouple and carbon monoxide levels is known from empirical data.

The invention has been described with reference to the preferred embodiment. Obviously modifications and alterations will occur to others upon a reading and understanding of this specification. It is intended to include all such modifications and alterations insofar as they come within the scope of the claims or the equivalents thereof.

Having thus described the invention, it is now claimed:

1. A carbon monoxide monitor for a gas fired appliance having a plenum into which gas is introduced for combustion on a screen comprising:

a solenoid valve that controls the flow of gas from an associated supply of gas to the appliance, the solenoid valve including a valve member that is biased by a spring toward a closed position and a coil associated with the valve member that is selectively energized to urge the valve member toward an open position against the force of the spring;

a thermocouple mounted to monitor the temperature of the screen, the thermocouple energizing the coil in response to combustion of the gas on the screen; and a proximity sensor for detecting changes in the current in the coil representative of an increase in carbon monoxide levels associated with the appliance and closing the solenoid valve in response thereto.

2. The monitor as defined in claim 1 wherein the thermocouple is mounted in the plenum to shield the thermocouple from ambient conditions.

3. The monitor as defined in claim 2 further comprising a reflector receiving radiant energy from the screen and directing it toward the thermocouple.

4. The monitor as defined in claim 3 wherein the reflector is a paraboloid for concentrating the radiant energy on the thermocouple.

5. The monitor as defined in claim 1 further comprising a reflector receiving radiant energy from the screen and directing it toward the thermocouple.

6. The monitor as defined in claim 5 wherein the reflector is a paraboloid for concentrating the radiant energy on the thermocouple.

7. The monitor as defined in claim 1 wherein the proximity sensor is a Hall-effect sensor that provides an output proportional to the magnetic field strength.

8. A carbon monoxide monitor for a gas fired appliance wherein the appliance includes a screen positioned in front of a plenum that receives fuel gas for combustion on the screen comprising:

a solenoid valve that controls the flow of gas from an associated supply of gas to the appliance, the solenoid valve including a valve member that is biased by a spring toward a closed position and a coil associated with the valve member that is selectively energized to urge the valve member toward an open position against the force of the spring;

a thermocouple mounted in the plenum to monitor the temperature of the screen, the thermocouple energizing the coil in response to combustion of the gas on the screen;

a reflector disposed adjacent the thermocouple for concentrating radiant energy from a marginal region of the screen on the thermocouple; and a proximity sensor for detecting changes in the current in the coil representative of an increase in carbon monoxide levels associated with the appliance and closing the solenoid valve in response thereto.

9. The monitor as defined in claim 8 wherein the reflector is a paraboloid for concentrating the radiant energy on the thermocouple.

* * * * *